US005749768A

United States Patent [19]

Green

[11] Patent Number: 5,749,768

[45] Date of Patent: May 12, 1998

[54] ADJUSTABLE CUP BRA

[76] Inventor: Andre Green, 912 Portland St., Apt. #4, Pittsburgh, Pa. 15206

[21] Appl. No.: 824,266

[22] Filed: Mar. 26, 1997

[51] Int. Cl.[6] ..... A41C 3/00; A41C 3/10; A41C 3/12

[52] U.S. Cl. ..... 450/65; 450/66; 450/67; 2/73

[58] Field of Search ..... 450/60, 61, 62, 450/63, 64, 65, 66, 67, 68, 69, 70, 74, 75, 76, 77, 78; 2/73, 105, 106, 67

[56] References Cited

U.S. PATENT DOCUMENTS

| | | | |
|---|---|---|---|
| 189,672 | 4/1877 | Weldon | 450/66 |
| 523,888 | 7/1894 | Foy | 450/68 |
| 560,282 | 5/1896 | Rew | 450/68 |
| 1,882,023 | 10/1932 | Malnick | 450/67 |
| 2,180,180 | 11/1939 | Versoy | 450/68 |
| 2,313,811 | 3/1943 | Dubner | 450/68 |
| 2,733,445 | 2/1956 | Champagne | 450/68 |
| 2,867,216 | 1/1959 | Champagne et al. | 450/68 |

*Primary Examiner*—Jeanette E. Chapman
*Attorney, Agent, or Firm*—Armstrong, Westerman, Hattori, McLeland & Naughton

[57] ABSTRACT

An adjustable cup bra having a pair of breast cups and a plurality of adjustable length straps connected to the edges of the bra cups and extending at least partially across the cups whereby, when the length of the straps on a cup is changed, the size of the cup is corresponding changed.

6 Claims, 1 Drawing Sheet

ADJUSTABLE CUP BRA

BACKGROUND OF THE INVENTION

1. Field of the Invention

This invention relates to improved brassieres or bras, specifically to a bra having adjustable breast cups to accommodate different or changing sizes of a woman's breasts.

2. Description of the Prior Art

The prior art is replete with many examples of different types of bras. All or most have adjustable shoulder straps; some have cups which can be wholly or partially opened, for example, when the wearer is lactating—so-called breast-feeding bras. To the best of my knowledge, no prior art bra has adjustable cups designed to fit different sized breasts or breasts of changing size.

SUMMARY OF THE INVENTION

The invention provides a bra with cups having adjustable straps spaced about the periphery of the cup so that each cup may be contracted or expanded in size.

DESCRIPTION OF PREFERRED EMBODIMENTS

Figure 1:
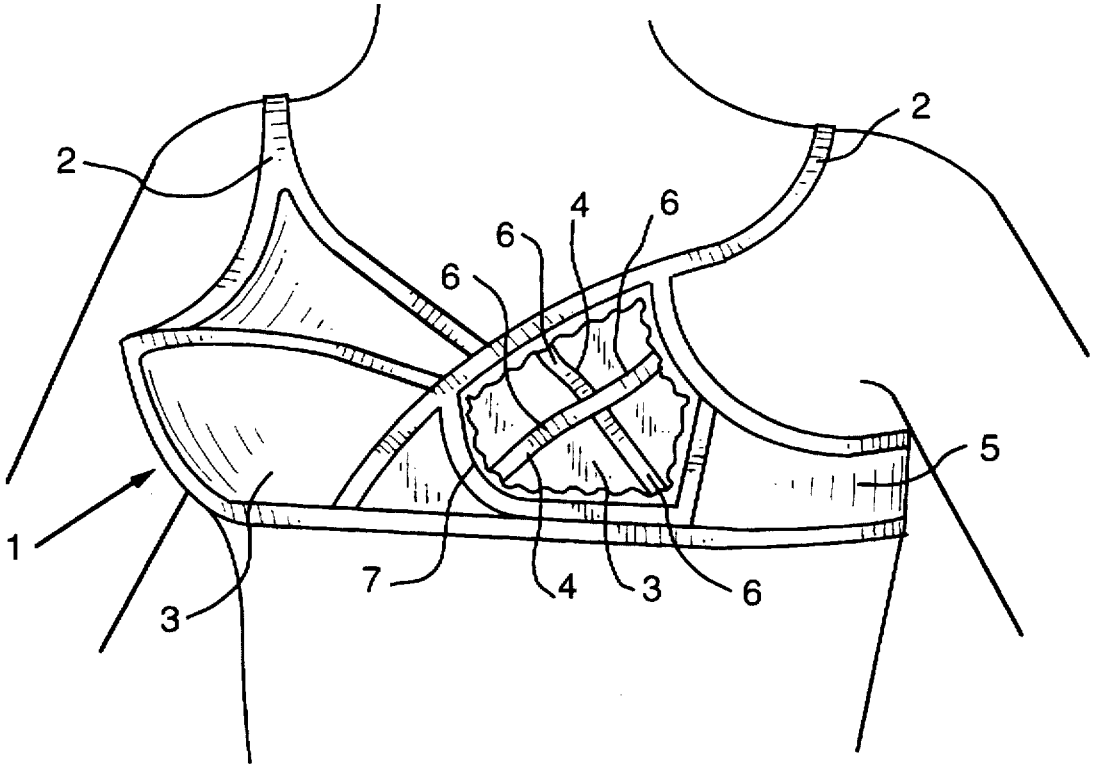
FIG. 1 is a front perspective view showing a bra in accordance with the invention having spaced apart adjustable straps extending across the cups.

In FIG. 1 there is shown a bra generally denoted by the numeral 1 with adjustable shoulder straps 2, elastic band 5, and comprising a pair of cups 3. Each of the cups 3 is provided with a number of adjustable straps 4, as shown in the right hand cup, extending across the cup from one side to the other. Each of the straps 4 is adjustable in length by means of a buckle 6 of usual design comprising a frame with a central bar providing a pair of slots through which the strap material can pass and be lengthened or shortened. The edges of the cups 3 may be provided with an elastic material as indicated by the numeral 7 to aid in the contraction or expansion of the material of the cups 3 on adjustment of the straps 4. The material of the cups 3 may be made of any suitable cloth material, but preferably is made of a spandex-type material which remains taut under application of tension. The non-wrinkling or non-gathering characteristic of the cups upon contraction of the cup size may be further promoted by providing the elastic material 7 about the edges of the cups. The adjustable straps are symmetrically spaced about the periphery of each cup and extend radially inward of the cup toward the center.

Figure 2:
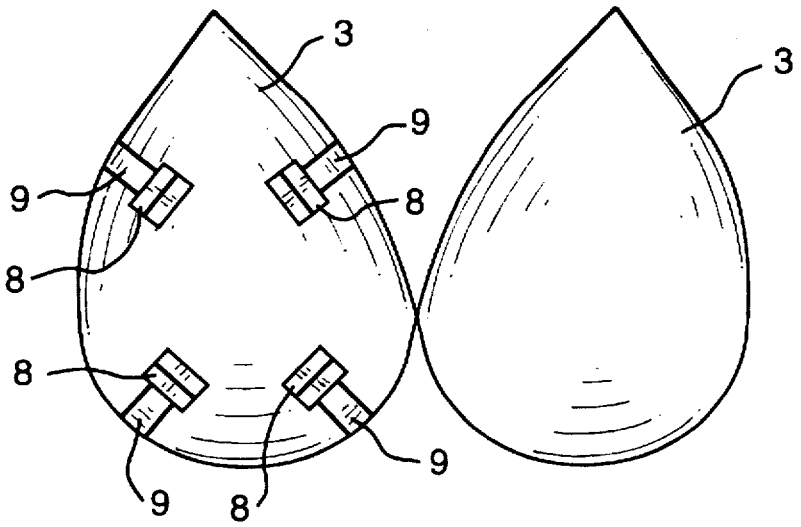
FIG. 2 is a front view of the cups of a modified bra of the invention in which the adjustable straps extend only partially across the cups.

An alternative embodiment of the bra of the invention is illustrated in FIG. 2. In that embodiment, buckles 8 are affixed to the material of the cups at points spaced from the edges of the cups but less than the distance from the edges to the center of the cups. Short straps 9 are affixed to the edges of the cups 3 and extend to the corresponding buckles 8, such that shortening or lengthening of the straps 9 will contract or expand the size of the cups 3.

A woman's two breasts are not always the same size, and the breasts may change in size under certain conditions, such as with prolonged strenuous exercise or when the wearer is lactating. Moreover, standard bras come in discrete cup sizes and a woman's breasts will not always be of exactly the same size as an available bra cup size. For both comfort and safety, the bra cups should exactly fit the size of the breasts of the wearer. The bra of the invention is useful in accommodating such differences so that each breast is perfectly accommodated within a correspondingly sized bra cup.

What is claimed is:

1. An adjustable cup bra comprising a pair of breast cups and a plurality of adjustable straps symmetrically spaced about a periphery of each cup and extending radially inwardly of the cup toward a center thereof, whereby on changing the length of straps the size of each cup may be changed.

2. A bra according to claim 1, wherein each strap extends from one edge of a cup across the cup to an opposide edge of the cup.

3. An adjustable cup bra comprising a pair of breast cups and a plurality of adjustable straps spaced about a periphery of each cup, wherein each strap extends from one edge of a cup across the cup for a distance less than that to a center of the cup, whereby on changing a length of the straps the size of each cup may be changed.

4. A bra according to claim 2, wherein there are two straps on each cup of the bra.

5. A bra according to claim 3, wherein there are four straps on each cup of the bra.

6. A bra according to claim 1, wherein each cup is provided with an elastic edge extending about the cup.

* * * * *